US007866636B1

(12) United States Patent
Hansen

(10) Patent No.: US 7,866,636 B1
(45) Date of Patent: Jan. 11, 2011

(54) STANCHION BASE SHOE SUPPORT FOR RAILINGS

(76) Inventor: Tracy C. Hansen, 4860 NW. Shute Rd., Hillsboro, OR (US) 97124

( * ) Notice: Subject to any disclaimer, the term of this patent is extended or adjusted under 35 U.S.C. 154(b) by 221 days.

(21) Appl. No.: 12/228,503

(22) Filed: Aug. 12, 2008

(51) Int. Cl.
*E04H 17/22* (2006.01)

(52) U.S. Cl. ..... 256/65.14; 52/296

(58) Field of Classification Search ..... 256/24, 256/65.02, 65.14, DIG. 6; 52/295–297, 126.3, 52/700, 832
See application file for complete search history.

(56) References Cited

U.S. PATENT DOCUMENTS

| | | | | | |
|---|---|---|---|---|---|
| 3,713,259 | A * | 1/1973 | Tkach | 52/111 |
| 3,921,356 | A * | 11/1975 | Hughes | 52/299 |
| RE28,643 | E * | 12/1975 | Blum | 256/24 |
| 4,054,268 | A * | 10/1977 | Sher | 256/24 |
| 4,067,548 | A * | 1/1978 | Murphy | 256/24 |
| 4,103,874 | A * | 8/1978 | Horgan, Jr. | 256/24 |
| 4,240,766 | A * | 12/1980 | Smith et al. | 404/10 |
| 4,690,383 | A * | 9/1987 | Batcheller | 256/24 |
| 4,841,697 | A * | 6/1989 | Hogg et al. | 52/208 |
| 4,995,206 | A * | 2/1991 | Colonias et al. | 522/97 |
| 5,081,811 | A * | 1/1992 | Sasaki | 52/223.13 |
| 5,200,240 | A * | 4/1993 | Baker | 428/34.1 |
| 5,456,441 | A * | 10/1995 | Callies | 248/521 |
| 5,483,775 | A * | 1/1996 | Redman | 52/204.62 |
| 5,666,774 | A * | 9/1997 | Commins | 52/298 |
| 6,029,954 | A * | 2/2000 | Murdaca | 256/59 |
| 6,367,224 | B1 * | 4/2002 | Leek | 52/704 |
| 6,517,056 | B2 * | 2/2003 | Shepherd | 256/24 |
| 6,547,223 | B1 * | 4/2003 | Letourneau | 256/65.02 |
| 6,964,410 | B1 * | 11/2005 | Hansen | 256/24 |
| 7,174,689 | B2 * | 2/2007 | Alyea et al. | 52/700 |
| 7,434,790 | B1 * | 10/2008 | Hansen | 256/24 |
| 7,559,536 | B1 * | 7/2009 | Hansen et al. | 256/25 |
| 7,677,522 | B2 * | 3/2010 | Bakos | 248/500 |
| 2007/0074485 | A1 * | 4/2007 | Fiehler | 52/782.1 |

* cited by examiner

*Primary Examiner*—Joshua T Kennedy
(74) *Attorney, Agent, or Firm*—Michael Tavella

(57) ABSTRACT

A stanchion base shoe support for railings. The stanchions are set into a concrete slab or curb during the construction. Only the top surface of a mounting plate is exposed prior to mounting the base shoe extrusion. The stanchion is constructed from steel or a similar material. A flange plate at the top of the stanchion provides an easy place to mount a temporary support member when placing the stanchion into the concrete formwork. The stanchion system eliminates all field drilling of concrete. The stanchions have a top plate and cylindrical members that have a set of internal threads. After the concrete is cured, workers apply a base shoe, securing it to the stanchions. This makes drilling and securing the base shoe simpler, easier and more accurate. Once the base shoe is installed, the railing system is built up in the normal manner.

15 Claims, 14 Drawing Sheets

STANCHION BASE SHOE SUPPORT FOR RAILINGS

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to base shoes glass railing systems and particularly to base shoes having stanchion supports.

2. Description of the Prior Art

This new invention serves to overcome a series of installation issues currently experienced by those mounting a base shoe for structural glass railing systems to a concrete surface.

The current state of the art, involves mounting the U-shaped base shoe to a concrete surface with some form of expansion bolt or self-tapping anchor. With this method, the installers must accurately drill both the extruded aluminum base shoe and the corresponding concrete balcony surface. The base shoe extrusion is typically drilled in factory conditions based on field dimensions, and the concrete surface is obviously drilled in the field using masonry drills and special concrete bits. The alignment and spacing of these holes are critical to the success of the installation. Given that many typical installations require holes spacing in the 6" to 12" range, many holes must be very accurately drilled. Holes that are drilled in the wrong position or even slightly out of alignment will likely not allow the fasteners to engage. Then, the entire assembly must be removed, and new holes drilled for each of the affected locations before and another attempt to fit the base shoe is made. It is common that even when all holes line up properly, the anchors will not engage properly due to galling of the threads or an anchor that has improper engagement in the slab spins in its hole. These problems also require the complete disassembly of the base shoe section until all locations are remedied. In fact, the potential for problems with this mounting method is so great that many General Contractors now require an independent consulting engineer to sign off on the proper installation of each fastener to verify that the finished system meets the minimum engineering requirements. It is also known that concrete anchors that utilize an expansive action or thread-cutting action to create the mechanical connection exert stress to a concrete structure and increase the possibility of spalling and cracking at each drilled location. Given that field labor costs are so negatively impacted by this inefficient installation method, a new mounting method had to be created.

BRIEF DESCRIPTION OF THE INVENTION

The instant invention overcomes these problems. It solves the installation issues described above because the base shoe mounts to an embedded steel stanchion rather than the concrete. This stanchion is cast into the concrete slab or curb during the construction or renovation of the structure. The stanchion is constructed from steel or a similar material. The stanchion has a vertical centrically member that is embedded in the concrete and a flange plate, positioned at the top of the stanchion, which provides an easy place to mount a temporary support member when placing the stanchion into the concrete formwork. The flange plate has threaded members, which are capped at the bottom to keep concrete and other debris out of the threaded area. Only the top surface of the flange plate is exposed prior to mounting the base shoe extrusion. The installation contractor can have this component painted or coated to protect against corrosion. Given the much greater strength of this type of mounting method, the base shoe requires fewer drilled holes.

The flat surface of the flange also aids the concrete contractor in floating the fresh concrete pour so that it maintains an even height from stanchion to stanchion. The stanchion embed typically has a removable film on the exposed face of the flange to keep concrete and other debris from fouling the threads on the device. A further advantage of the embedded stanchions is that, unlike concrete anchors, an embedded, or cast, element does not exert any stress or pressure to a concrete system. Moreover, field drilling of concrete creates hazardous cement dust and requires the technician to wear protective respirator equipment. The stanchion embed system eliminates all field drilling of concrete. A vent hole is formed in the flange plate to allow air to escape when inserting the stanchion into a core pocket that is already filled with grout. The stanchion tube portion is machined with a notch to act as a grout lock.

After the concrete is cured, workers apply the base shoe, securing it to the stanchions. This makes drilling and securing the base shoe simpler, easier and more accurate. Once the base shoe is installed, the railing system is built up in the normal manner.

DETAILED DESCRIPTION OF THE INVENTION

Figure 1:
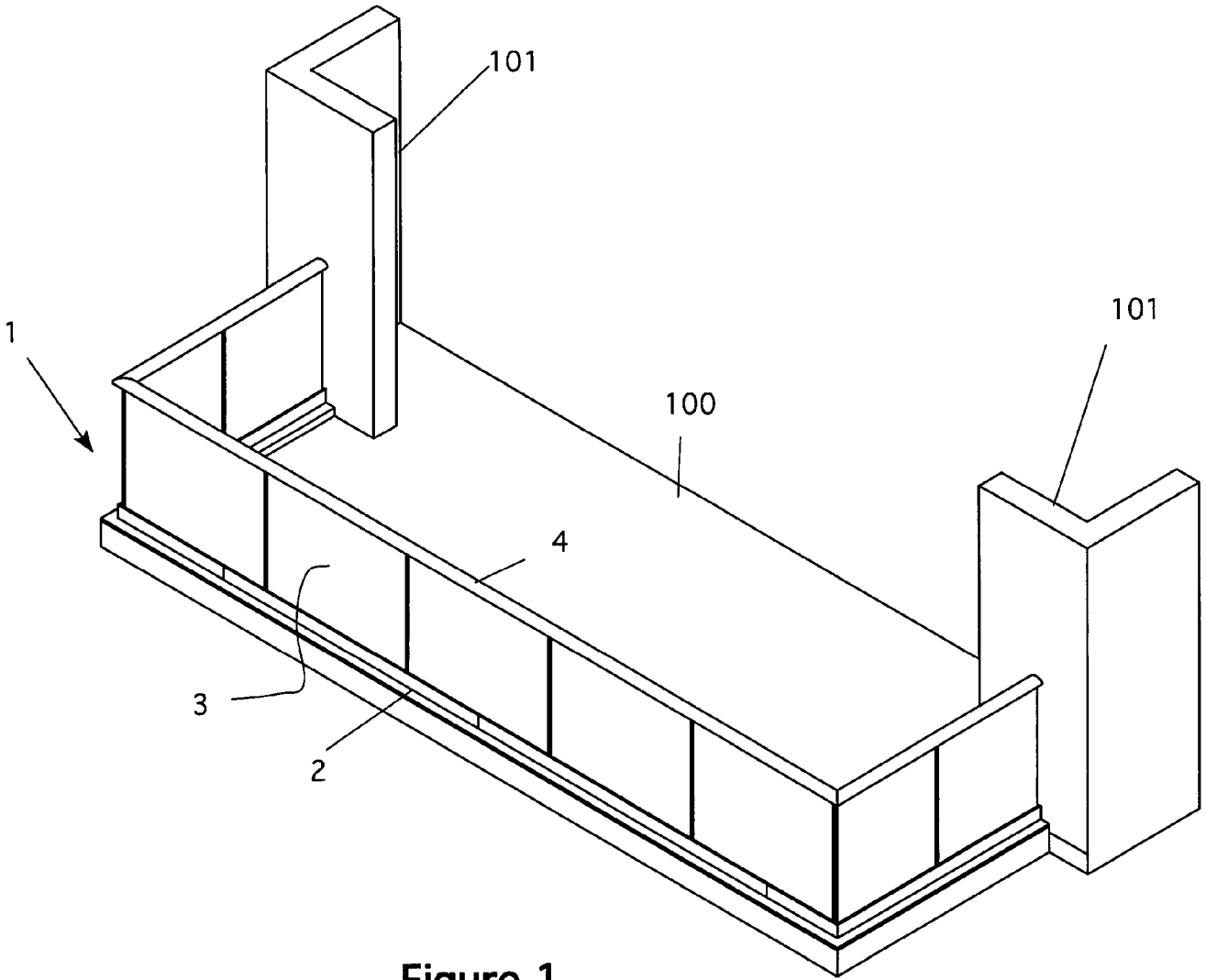
FIG. 1 is a perspective view of a railing incorporating the new design.

Referring now to FIG. 1, a perspective view of a railing incorporating the new design is shown. Here, a balcony 100 with building walls 101 is shown. The balcony is typically reinforced concrete. At the outer perimeter of the balcony is a railing 1. The railing has a base shoe 2, a number of infill panels 3 and a top rail 4. The infill panels 3 are typically glass, but can be any material ordinarily used for the purpose. The major difference between this railing system and others commonly used is that the base shoe 2 is not mounted directly into the concrete slab or curb. Rather, the base shoe 2 is secured to a number of stanchions that are embedded into the concrete.

Figure 2:
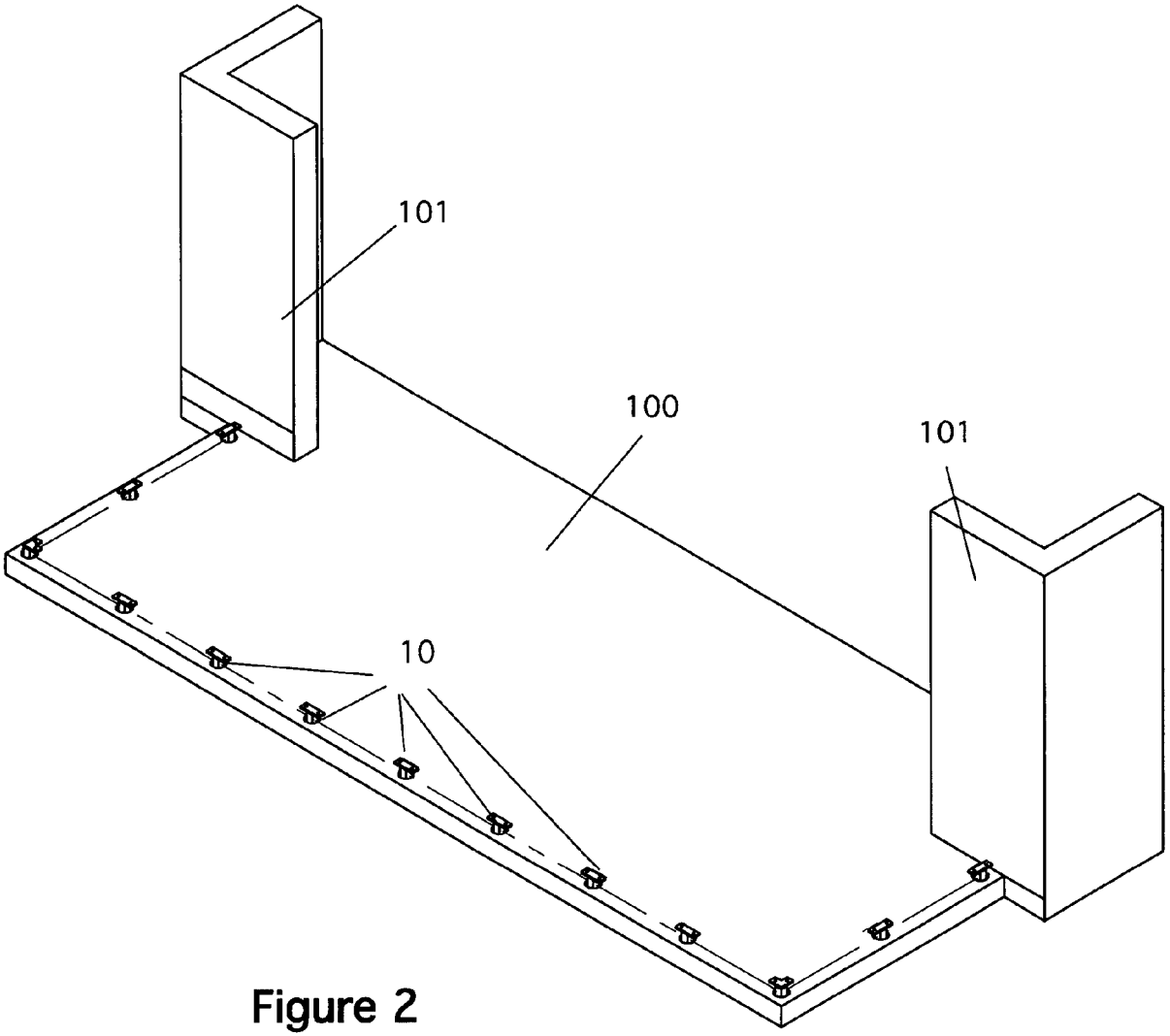
FIG. 2 is a perspective view of a balcony with a set of stanchions embedded in a concrete curb.

FIG. 2 is a perspective view of a balcony with a set of stanchions embedded in a concrete curb. Here, the balcony 100 is shown without the base shoe and railing in place. In this view, the stanchions 10 are clearly shown.

Figure 3:
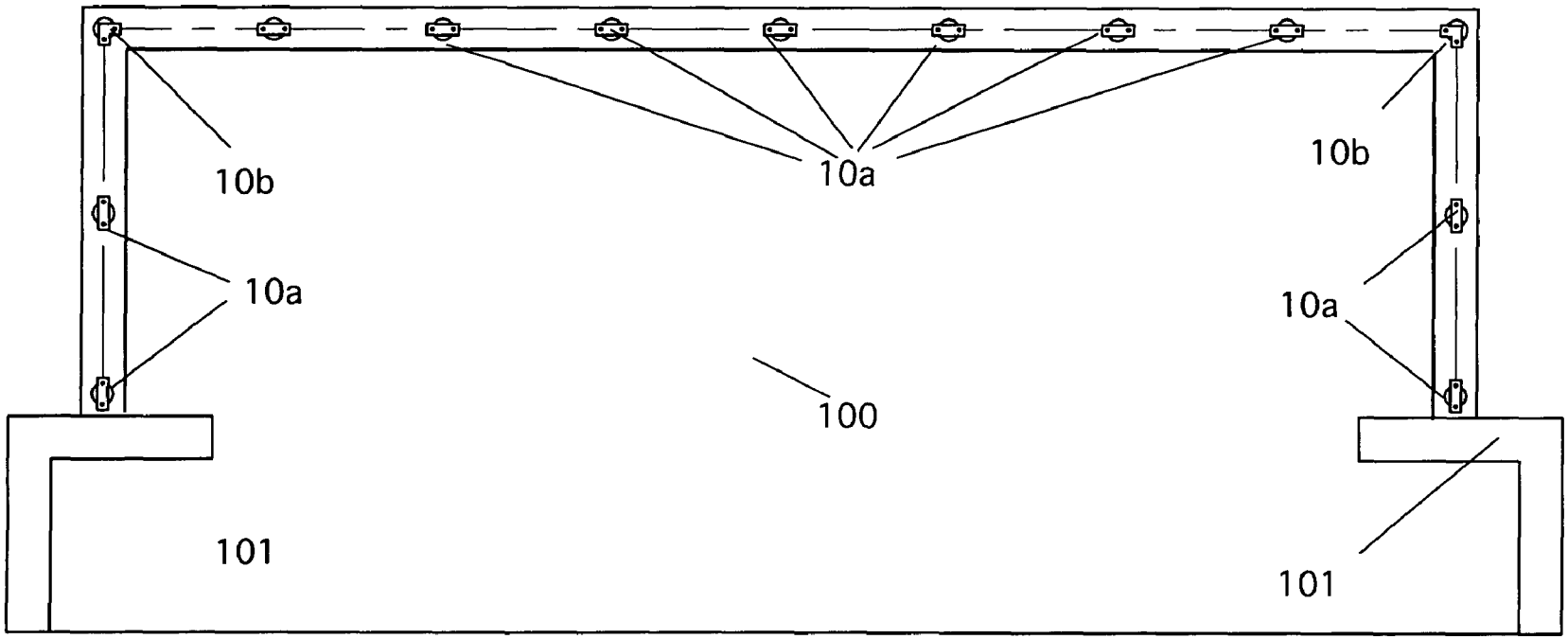
FIG. 3 is a top plan view of a balcony with a set of stanchions embedded in a concrete curb.

FIG. 3 shows the stanchions 10 embedded in a concrete curb in a plan view. Note that there are two types of stanchions used. The first type 10 is used in straight sections. As shown, the straight section stanchions 10 have a straight flange plate. The second type 10*b* are used at corners. These stanchions have a flange plate that is "L" shaped to form a right angle.

Figure 4:
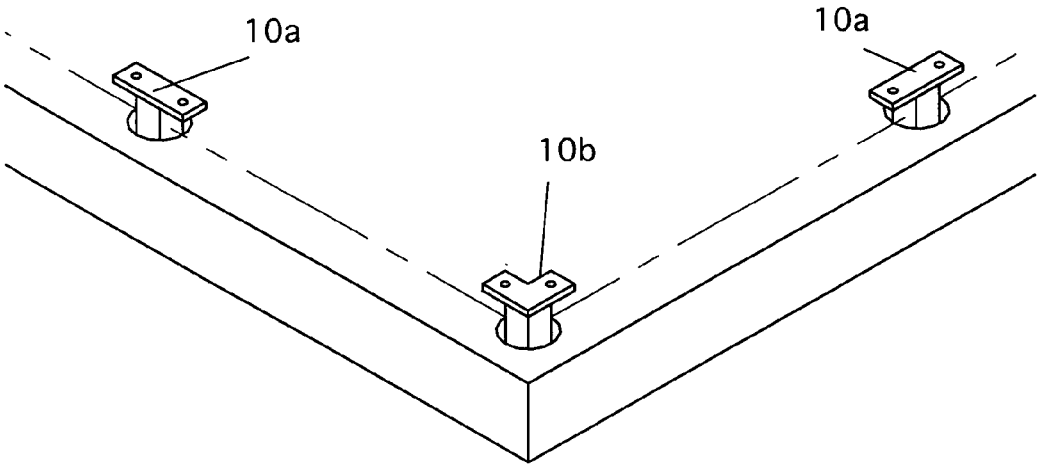
FIG. 4 is a perspective view of a corner section of the balcony showing placement of a corner stanchion for a system that is not installed in a concrete curb.

FIG. 4 is a perspective view of a corner section of the balcony showing placement of a corner stanchion 10*b* and straight section stanchions 10.

Figure 5:
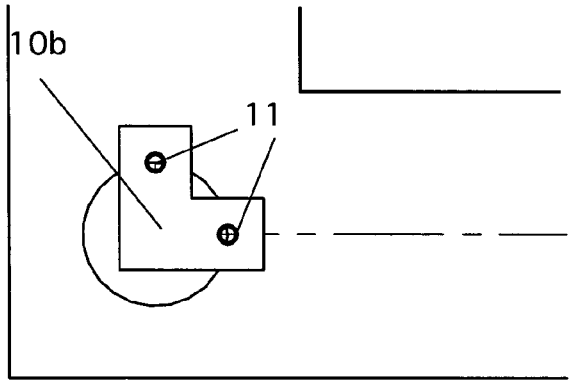
FIG. 5 is a plan view of a corner stanchion.

FIG. 5 is a plan view of a corner stanchion 10*b*. Note that each stanchion has a pair of holes 11 drilled as shown. These holes are used to secure the base shoe to the stanchions, as discussed below.

Figure 6:
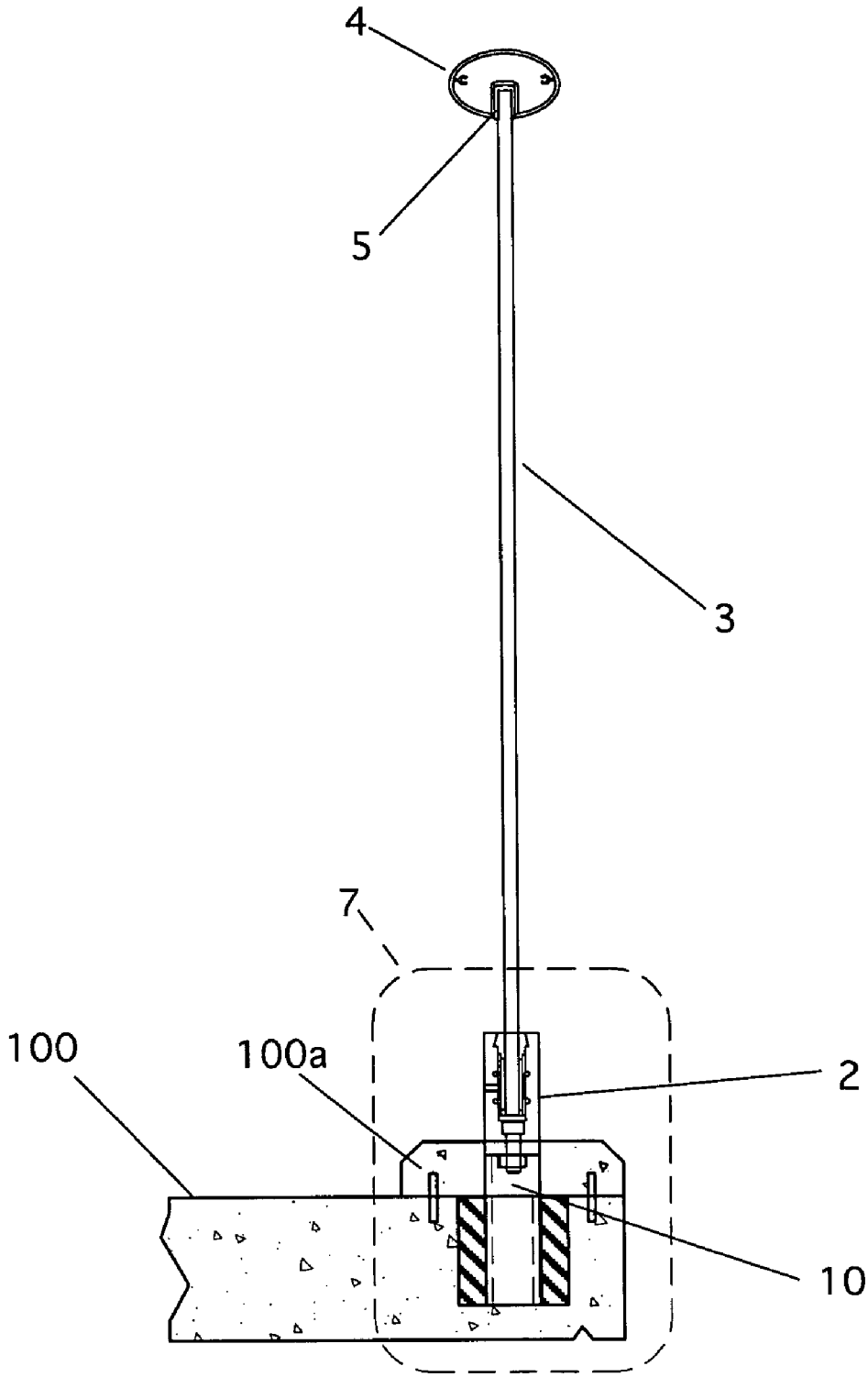
FIG. 6 is a cross-section of a railing showing the placement of the major components.
Figure 7:
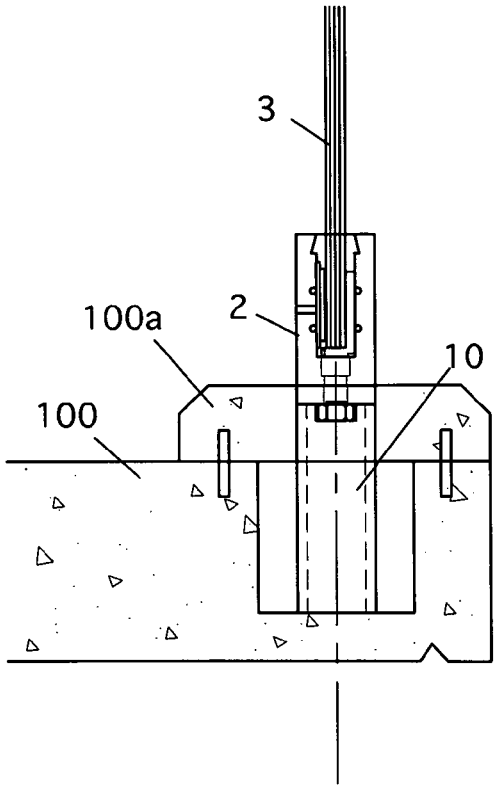
FIG. 7 is an enlarged detail view of the portion of FIG. 6 labeled "7".
Figure 7A:
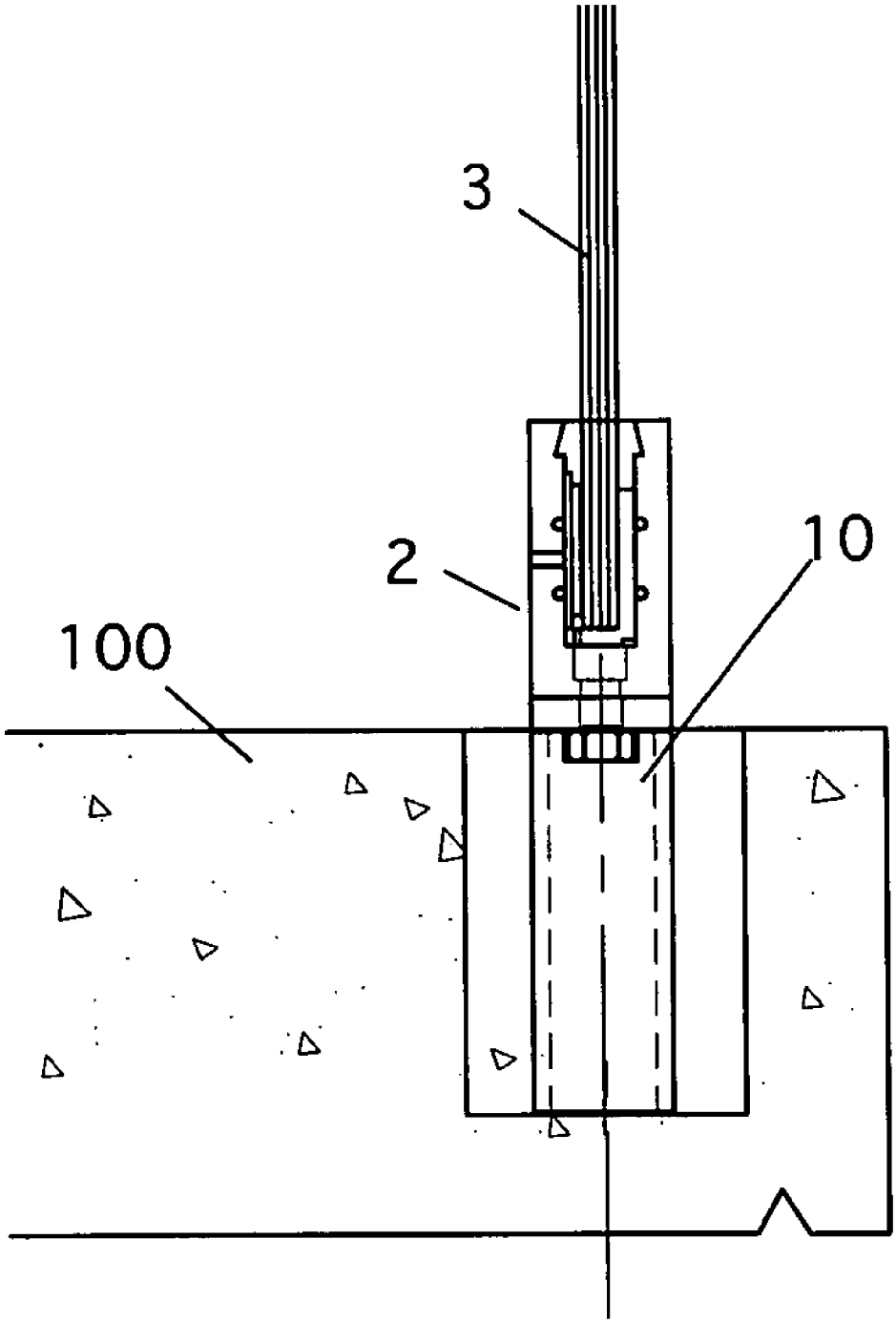
FIG. 7*a* is a modified version of FIG. 7 showing the system installed without a concrete curb.

FIG. 6 is a cross-section of a railing showing the placement of the major components. At the top of the assembly is a top rail 4. Note that the top rail 4 has a channel 5 to receive the infill panel 3. The infill panel 3 is set in a base shoe using any common method. This figure show a system using a pressure plate system, discussed below. The base shoe 2 is secured to the stanchions 10, which are embedded in a concrete curb 100*a*, which is set on the balcony 100 as shown in FIG. 7, or, the curb can be omitted and the stanchions are then set in the slab itself, as shown in FIG. 7*a*. FIG. 7 is an enlarged detail view of the portion of FIG. 6 labeled "7". FIG. 7*a* is a modified version of FIG. 7 showing the system installed without a concrete curb.

Figure 8:
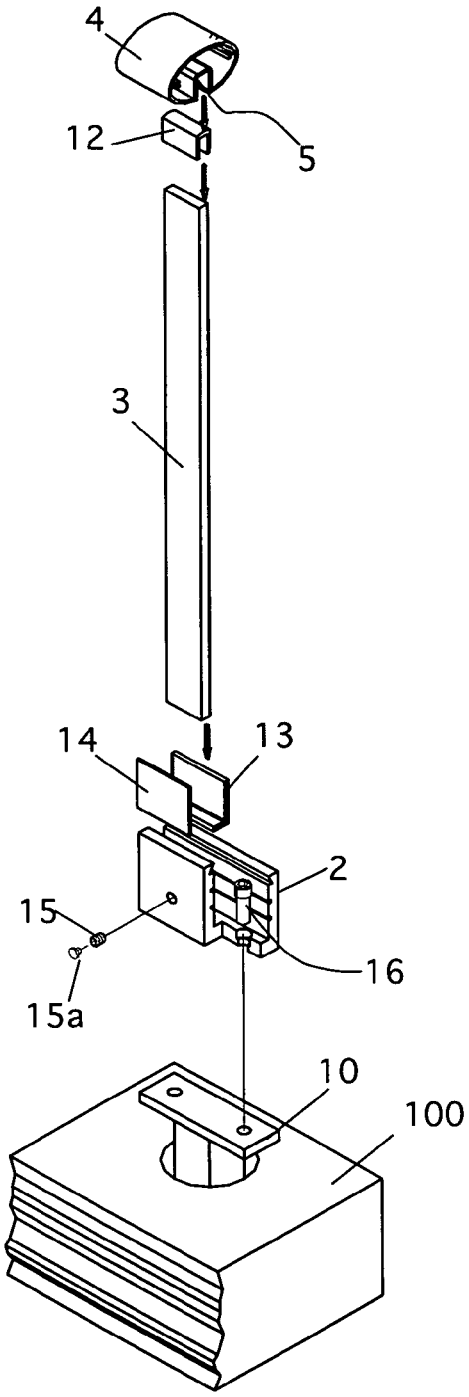
FIG. 8 is a partially exploded perspective view of the section shown in FIG. 6.

FIG. 8 is a partially exploded perspective view of the section shown in FIG. 6. Here, the key components of the preferred installation system are shown. Again, at the top is the top rail 4. In the channel 5 a rigid PVC insert 12 is placed to insulate the infill panel (glass or similar material). The infill panel is placed into a rigid PVC protective insert 13, which protects the glass when it is inserted into the base shoe 2. A stainless steel plate 14 is positioned opposite to the PVC pad. The stainless steel plate is coated with a neoprene pad 14*a* on the surface facing the infill panel (see FIG. 9). A setscrew 15 is used to secure the assembly in place, as discussed below; this screw is covered by a cap 15*a*. As discussed above, this is the preferred embodiment, however, many methods that can be used to hold the infill panels in place. In this figure, the steel stanchion 10 is shown installed in the concrete slab 100. The base shoe 2 is secured to the stanchion using two stainless steel socket drive cap head screws 16.

Figure 9:
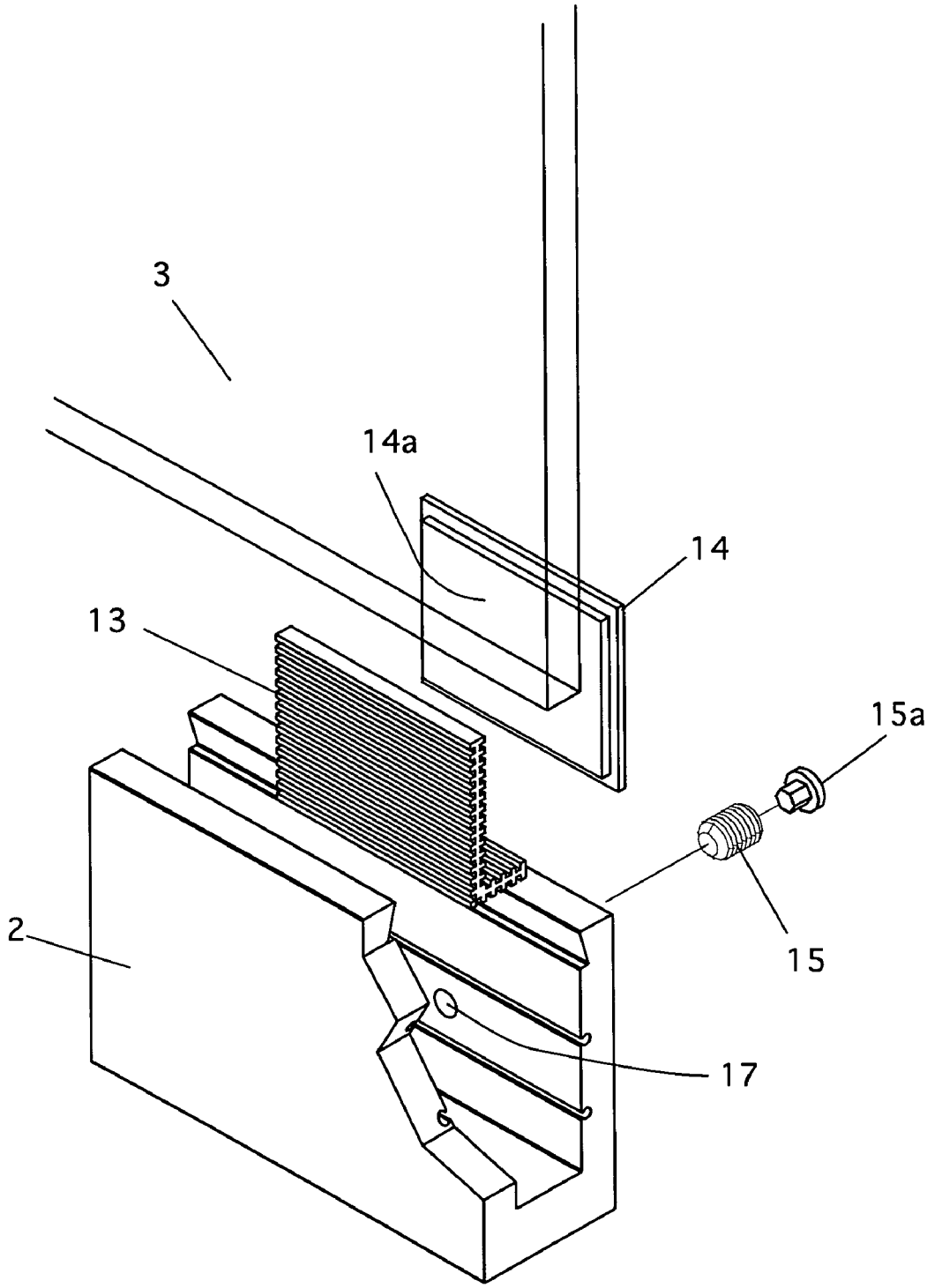
FIG. 9 is an enlarged detail view of the infill installation system.

FIG. 9 is an enlarged detail view of the preferred infill installation system. Here, the infill panel 3 is shown above the base shoe 2. At the rear of the panel is the stainless steel plate 14 showing the ⅛-inch thick neoprene pad 14*a*. In the front of the infill panel is the rigid PVC compression pad 13. The setscrew 15 is secured to the base shoe through holes 17 placed at regular intervals in the base shoe. A cap 15*a* is used to cover the top of the screw for aesthetic reasons.

Figure 10:
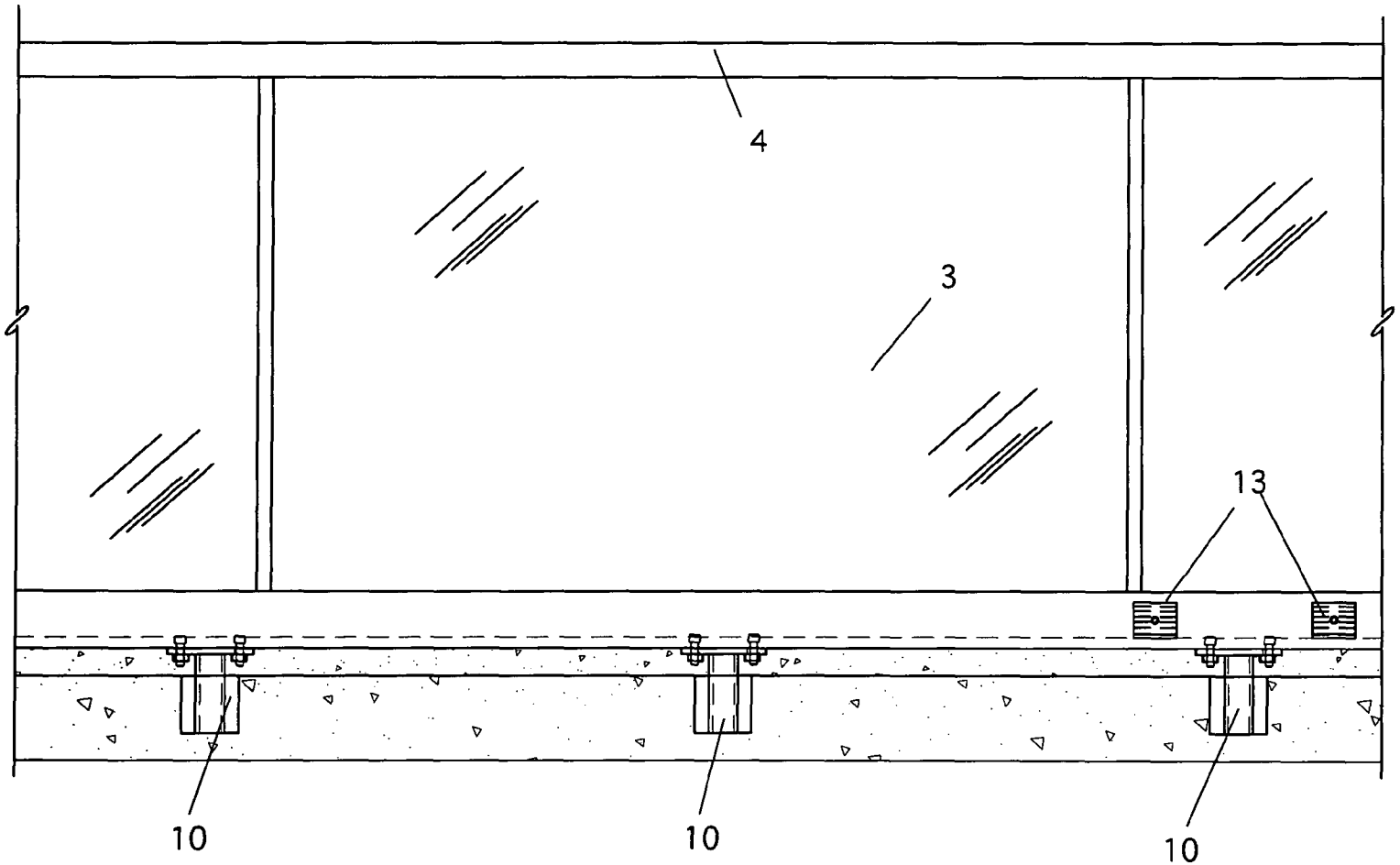
FIG. 10 is an elevation view of a portion of a railing system using the instant invention.

FIG. 10 is an elevation view of a portion of a railing system using the instant invention. Here all of the key components are shown. The stanchions 10 are shown spaced apart in the slab 100. The base shoe 2 is shown secured to the stanchions. The infill panels 3 are installed in the base shoe and the top rail 4 is attached to the infill panels. Note that this view shows the spacing of the rigid PVC compression pads 13 (only two are shown, but the pad systems are distributed along the base show at regular intervals). Note that the setscrews, the stainless steel plates 14 and the ⅛-inch thick neoprene pad 14*a* are placed at these positions as well, as shown in FIG. 9. This system provides stability without complex field installation techniques being required.

Figure 11:
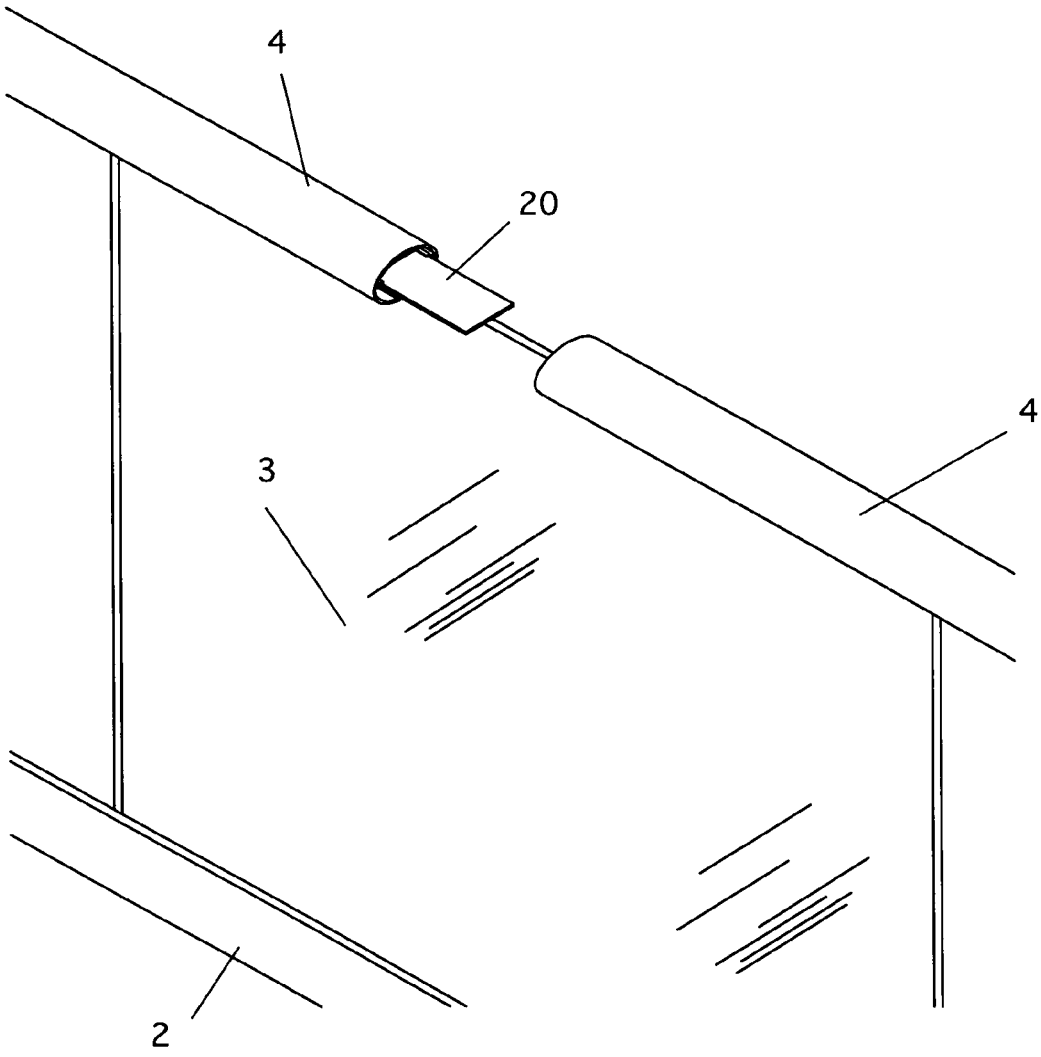
FIG. 11 is a detail of a top rail splice.

FIG. 11 is a detail of a top rail splice. In long runs, the top rail sections are joined by splices 20 as needed.

Figure 12:
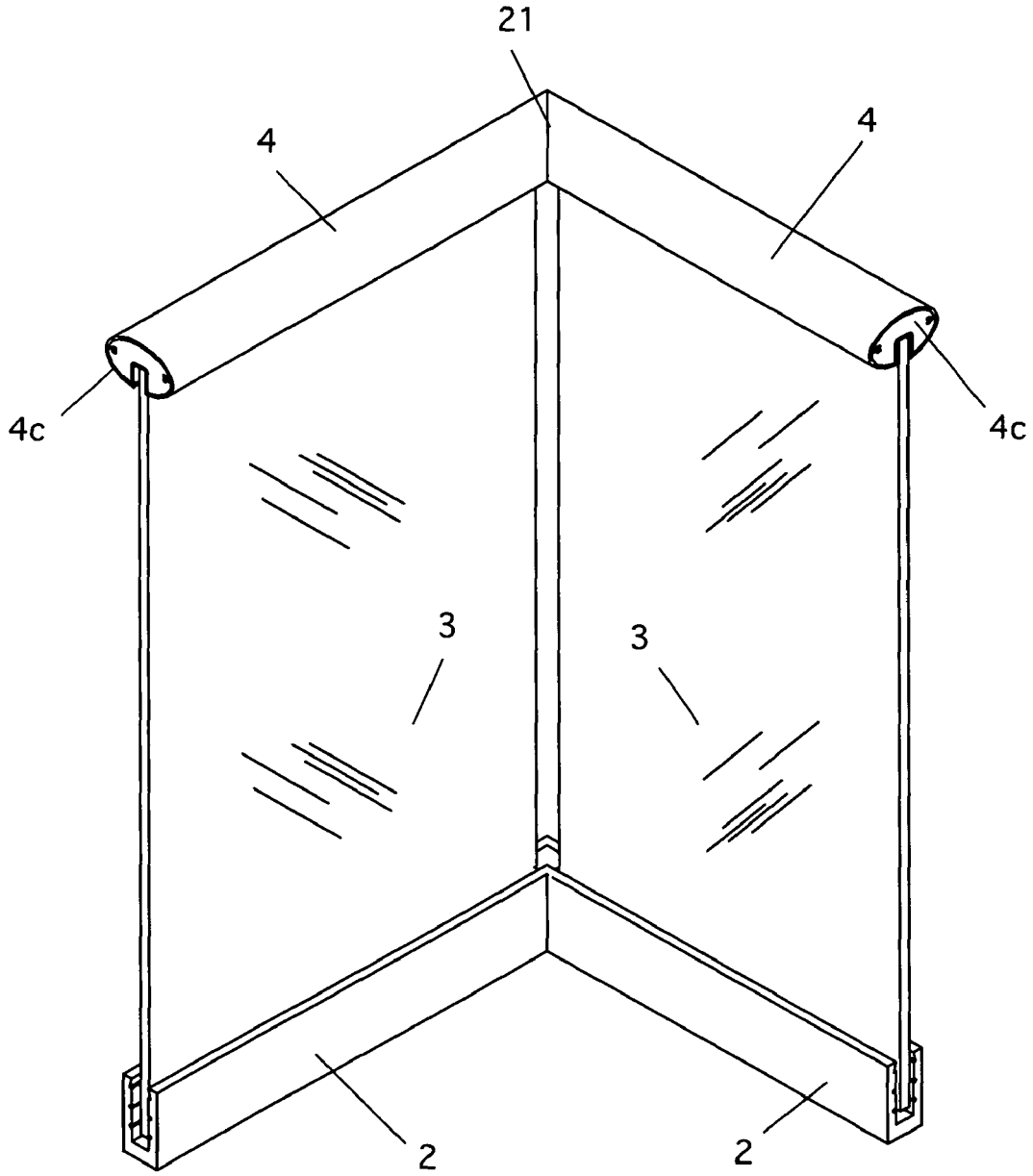
FIG. 12 is a detail of a corner section of a railing using the instant invention.

FIG. 12 is a detail of a corner section of a railing using the instant invention. At corners, the top rail sections are cut at miters 21. These are the only field cuts that need to be made and are relatively straightforward and generally kept to a minimum. These miters are formed using standard techniques. Note that the corners use the corner stanchions as discussed above. Note this figure also shows two end caps 4*c* attached to the ends of the top cap 4.

Figure 13:
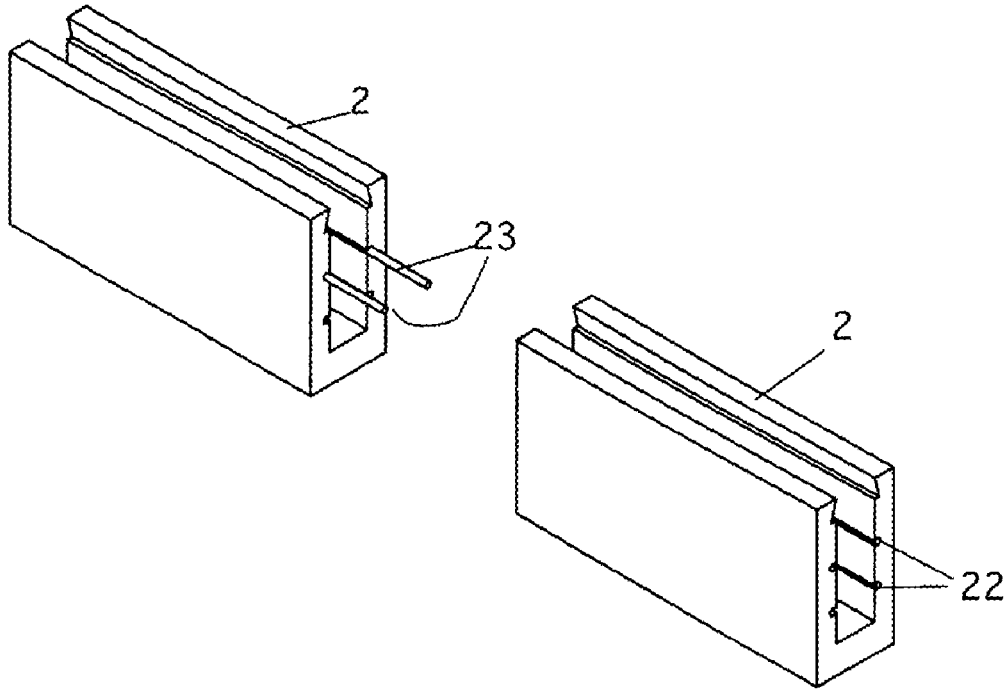
FIG. 13 is a detail of a base shoe joint showing splice pins installed.
Figure 17:
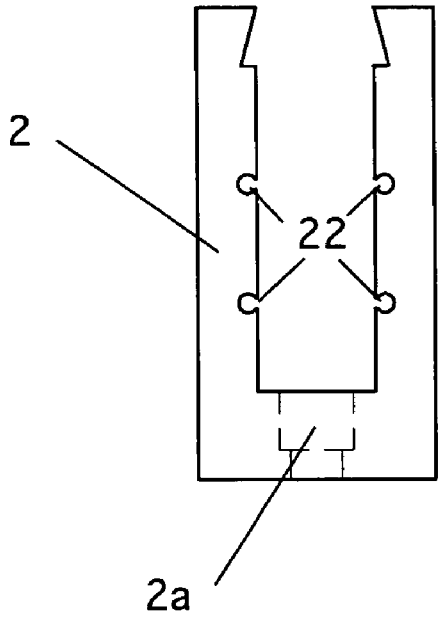
FIG. 17 is a side detail view of a section of base shoe.

FIG. 13 is a detail of a base shoe joint showing splice pins installed. As shown in FIG. 17, the sections of base shoe 2 have rounded openings 22 in them that receive splicing pins 23. The splicing pins are used to connect lengths of base shoe as needed for long runs. Of course, any style and size of base shoe can be used with this system. This is only one example.

Figure 14:
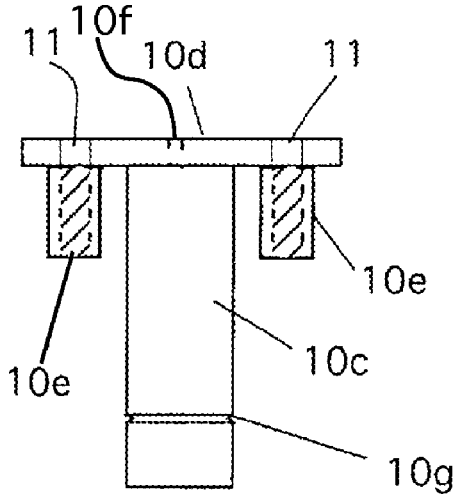
FIG. 14 is a side detail view of a stanchion.

FIG. 14 is a side detail view of a stanchion 10. In the preferred embodiment, the stanchion base 10*c* is made of 2 in×2 in×¼-inch wall type 304 stainless steel tubing 6 inches long. The top plate 10*d* is preferably made of ½×2 inch type 304 stainless steel plate, also 6 inches long. At the base of the plate on both sides of the stanchion are two threaded cylinders 10*e* with ½-inch threads that are formed on the base of the stanchion plate. Two clearance holes 11 are drilled through the plate to accommodate the fasteners as discussed above. A vent hole 10*f* is provided in the top flange plate to allow air to escape when inserting the stanchion into a core pocket that is already filled with grout. A grout lock 10*g* can be formed near the bottom of the stanchion base 10*c* as shown. This is essentially a V-groove cut into the base.

The stanchions can be cast directly into the concrete slab or curb during the construction or renovation of the structure. In these installations, only the top surface of the top plate 10*d* is exposed prior to mounting the base shoe extrusion. The top plate 10*d* also provides an easy place to mount a temporary support member when placing the stanchion into the concrete formwork. The flat surface of the flange also aids the concrete contractor in floating the fresh concrete pour so that it maintains an even height from stanchion to stanchion. The stanchion embed typically has a removable film on the exposed face of the flange to keep concrete and other debris from fouling the threads on the device.

Figure 15:
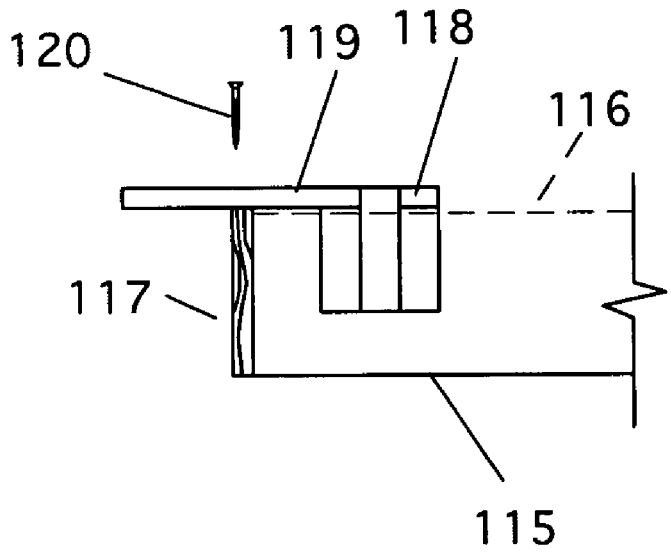
FIG. 15 is a side detail view of one type of block out piece used in forming for pouring concrete.
Figure 16:
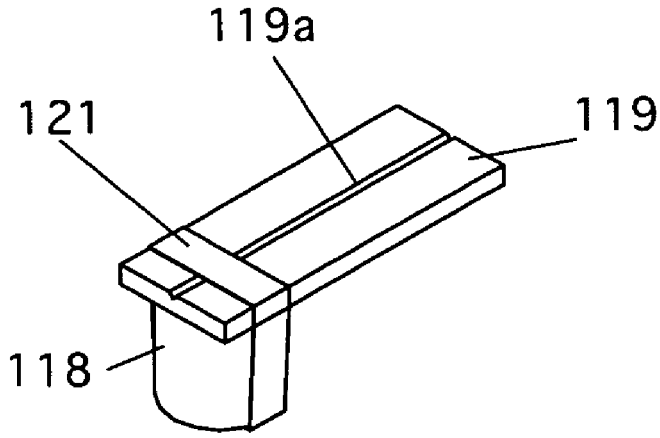
FIG. 16 is a perspective view of the block out piece of FIG. 15 used in forming for pouring concrete.

Although it is possible to cast the stanchions directly into the concrete, it is also possible to create holes in the pour into which the stanchions are set after the concrete cures. This is done using grout in an ordinary manner. One method to create the stanchion pockets uses block out pieces. FIG. 15 is a side detail view of one type of block out piece used in forming for pouring concrete. In the figure, the deck base 115 is shown as well as a dashed line 116 that indicates the position of the top of the poured concrete. A form board 117 is the standard forming used to pour the slab. Foam block out pieces 118 and plywood 119 are used to create the needed space in the slab for the stanchions. Note that the plywood pieces 119 are secured to the form board by nails 120. FIG. 16 is a perspective view of block out piece used in forming for pouring concrete. Here, the lower foam block 118 is shown. In the preferred embodiment, this foam block is 4 inches in diameter (or 4 inches square) and 4 inches long. The top board 119 is a length of ¾-inch plywood. A groove 119*a* is cut to line up the block out pieces at the proper locations along the main form. The block 118 is secured to the plywood with construction adhesive and with adhesive tape 121.

FIG. 17 is a side detail view of a section of base shoe 2. In the preferred embodiment, the base shoe is 4 inches long and 2 inches wide, although any other size of base shoe can be used. It has a through hole 2*a* through which the mounting hardware is run. In this view, the rounded openings 22 for splicing are also shown.

Figure 18:
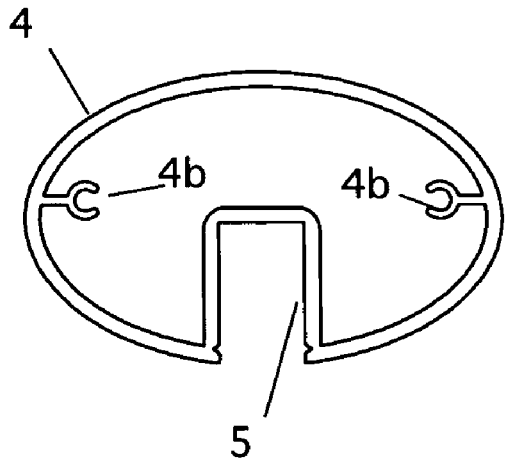
FIG. 18 is an end view of a section of top rail.

FIG. 18 is an end view of a section of top rail 4. In the preferred embodiment, this rail is 2½-inches high. It has a ¾-inch notch 5 to receive the infill panel. Two anchor clips 4*b* are also shown. These clips receive fasteners for an end caps 4*c* (see FIG. 12). Again, any size or style of top rail can be used with this system. The type shown is not intended to be limiting.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A stanchion base shoe support comprising:

a) a base tube, installed in a concrete surface;

b) a top plate, having a flat, solid upper surface, also having a bottom, fixedly attached to said base tube such that said top plate and base tube form a "T" configuration; and c) a means for accepting base shoe fasteners, attached to said top plate, said means including a pair of mounting holes formed in said top plate and a pair of threaded cylinders for receiving a pair of fasteners inserted downwardly through the pair of mounting holes formed in said top plate, fixedly attached to the bottom of said top plate, and further wherein said pair of threaded cylinders is in alignment with said pair of mounting holes formed in said top plate.

2. The stanchion base shoe support of claim 1 wherein the concrete surface is a concrete slab.

3. The stanchion base shoe support of claim 1 wherein the concrete surface is a concrete curb attached to a concrete slab.

4. The stanchion base shoe support of claim 1 wherein the top plate is configured in a 90-degree angle with respect to the base tube such that the base tube lies in a vertical plane and the top plate lies in a horizontal plane with respect thereto.

5. The stanchion base shoe support of claim 1 wherein the top plate further comprises a vent hole formed in the top plate to allow air to escape when inserting the base tube into a core pocket in said concrete surface that is already filled with grout.

6. The stanchion base shoe support of claim 1 wherein the base tube further comprises a grout lock, formed on said base tube.

7. The stanchion base shoe support of claim 6 wherein said grout lock comprises a V-groove cut into said base tube.

8. A railing system comprising:

a) a plurality of stanchions being embedded in a concrete surface, each of said plurality of stanchions having a solid, flat, top plate being oriented in a horizontal plane above said concrete surface and a base tube, each of said top plates having a pair of mounting holes formed therein;

b) a pair of threaded cylinders, for receiving a pair of fasteners inserted downwardly through the pair of mounting holes formed in said top plate, fixedly attached to the bottom of each top plate of said plurality of stanchions; and further wherein said pair of threaded cylinders is in alignment with each of said pair of mounting holes formed in the top plate of each of said plurality of stanchions;

c) a base shoe, removably attached to said plurality of stanchions;

d) a plurality of infill panels installed in said base shoe; and e) a top rail attached to said plurality of infill panels.

9. The railing system of claim 8 wherein the concrete surface is a concrete slab.

10. The railing system of claim 8 wherein the concrete surface has a concrete curb attached to a concrete slab.

11. The railing system of claim 8 wherein the top plate of each of said plurality of stanchions further comprises a vent hole formed in the top plate of each of said plurality of stanchions.

12. The railing system claim 8 further comprising at least one corner stanchion.

13. The railing system of claim 12 wherein the at least one corner stanchion comprises:

a) a base tube;

b) a top plate, having a bottom and a top; fixedly attached to said base tube such that said top plate and base tube form a "T" configuration and further wherein said top plate has a first end and a second end and further wherein said first end and said second end extend orthogonally from said base tube in a horizontal plane.

14. The railing system of claim 8 wherein the base tube of each of said plurality of stanchions further comprises a grout lock, formed on base tubes.

15. The railing system of claim 14 wherein said grout lock comprises a V-groove cut into the base tube of each of said plurality of stanchions.

* * * * *